US005442138A

United States Patent [19]

Ochi

[11] Patent Number: 5,442,138

[45] Date of Patent: Aug. 15, 1995

[54] INSULATOR FOR TERMINAL-CONNECTING PORTION

[75] Inventor: Hiroyuki Ochi, Mie, Japan

[73] Assignee: Sumitomo Wiring Systems, Ltd., Mie, Japan

[21] Appl. No.: 140,316

[22] Filed: Oct. 22, 1993

[30] Foreign Application Priority Data

Oct. 23, 1992 [JP] Japan ..... 4-079755 U

[51] Int. Cl.[6] ..... H01R 13/62

[52] U.S. Cl. ..... 174/138 F; 174/135; 174/72 R; 439/368

[58] Field of Search ..... 174/138 F, 72 B, 72 R, 174/138 R, 135, 82, 83, 74 A; 439/367, 368, 369

[56] References Cited

U.S. PATENT DOCUMENTS 3,147,338 9/1964 Ekvall et al. ..... 174/138 F
3,571,782 3/1971 Colbert ..... 174/138 F X
4,435,612 3/1984 Smith ..... 174/92
4,861,282 8/1989 Kobayashi et al. ..... 439/540

FOREIGN PATENT DOCUMENTS 620832 5/1961 Italy ..... 174/138 F

*Primary Examiner*—Leo P. Picard
*Assistant Examiner*—Paramita Ghosh
*Attorney, Agent, or Firm*—Sughrue, Mion, Zinn, Macpeak & Seas

[57] ABSTRACT

An insulator for a terminal-connecting portion has a sufficient force for holding a terminal and can drain water efficiently. An insulator body 100 is provided with a draining hole 140 on a side wall part 133 which is one of the exterior walls forming a curved portion 130. Since the draining hole 140 is provided on the side wall part, an outer corner wall part 131 of the curved portion 130 is left intact and an inner peripheral face of the outer corner wall part 131 is closely and elastically mounted on a corner 64 of a female terminal 60. Since an inner peripheral face of another end 120 of the insulator body 100 is closely and elastically mounted on two corners 62 and 63 out of three remaining corners 61 to 64, the female terminal 60 is supported on three points, so that a sufficient force of holding a terminal can be obtained. Further, it is possible to efficiently drain water such as rain or the like, which enters into the insulator body 100, from the draining hole 140, since the hole 140 can be formed into a large diameter.

5 Claims, 14 Drawing Sheets

INSULATOR FOR TERMINAL-CONNECTING PORTION

BACKGROUND OF THE INVENTION

1. Field of the Invention

This invention relates to an insulator for a terminal-connecting portion to be mounted on or around an ignition coil or a horn of a motor-cycle or the like.

2. Statement of the Prior Art

For convenience of explanation, a prior insulator for a terminal-connecting portion will be described below by referring to FIGS. 24 to 27.

FIG. 24 is a perspective view of a prior insulator A for a terminal-connecting portion, FIGS. 25 and 26 are cross sectional views illustrating the insulator A and FIG. 27 is a front side view of the insulator A. As shown in these drawings, the insulator A includes a hollow L-shaped insulator body 1 made of an elastic material. The insulator body 1 is provided with a female terminal inlet 3 at one end 2 thereof and with a male terminal inlet 5 at the other end 4 thereof. Further, the insulator body 1 is provided with a draining hole 7 having a diameter of 1 mm at an outer corner wall part 6*a*. A peripheral wail of a curved portion 6 of the insulator body 1 is constituted by the outer corner wall part 6*a*, an inner corner wall part 6*b*, and opposite side wall parts 6*c*.

In this insulator A, a rectangular female terminal 11 connected to a main electrical cable 10 is inserted through the female terminal inlet 3 into the insulator body 1 while enlarging the inlet 3 against its elastic force. At this time, an inner peripheral face of the insulator body 1 closely contacts with three corner parts 11*b* to 11*d*, exclusive of a corner part 11*a* for connecting the main electrical cable 10, out of outer peripheral parts of the female terminal 11, in particular, four corner parts 11*a* to 11*d* by an elastic recovery force, thereby holding the female terminal 11 in the insulator body 1. By inserting a male terminal (not shown) connected to a joint electrical cable through the male terminal inlet 5 into the insulator body 1 as shown by an arrow R in FIG. 25, the male terminal is coupled to tile female terminal 11.

In the case that the outer corner part of the curved portion 6 is arranged at a lower position in the insulator A as shown in FIG. 25, rain or the like entering into the insulator A from the terminal inlets 3 and 5 is drained through the draining hole 7 to the outside.

However, since the draining hole 7 is as small as 1 mm in diameter in the prior insulator A, it is impossible to drain the entrapped water due to a surface tension.

In this case, it is possible to drain the entrapped water from a large draining hole 7*a* which is formed by cutting away the outer corner wall part 6*a*, as shown in FIG. 27. However, if such a large draining hole 7*a* is formed in the outer corner wall part 6*a* of the curved portion 6, the corner part 11*d* of the female terminal 11 is exposed from the draining hole 7*a* or in other words the corner part 11*d* is not protected by the insulator A and consequently the female terminal 11 is supported by only two corner parts 11*b* and 11*c*. so that the female terminal 11 is loosely mated in the insulator, the insulator A lowers its terminal-holding ability and the male terminal is hardly inserted into the female terminal. In addition, if the large draining hole 7*a* is formed in the part 6*a*. the corner part 11*d* of the female terminal 11 exposed from the hole 7*a* interferes with a peripheral portion of the insulator A, thereby causing a short circuit in the terminal.

SUMMARY OF THE INVENTION

A first object of the present invention is to provide an insulator for a terminal connecting portion, which can efficiently drain water such as rain or the like entering into the interior of an insulator body and exerts a substantial force for holding a terminal.

A second object of the present invention is to provide an insulator for a terminal connecting portion, which can effectively drain moisture such as rain or the like entering into tile interior of an insulator body, exerts a great force for clamping a terminal, and can prevent a short circuit in a terminal section.

In order to achieve the first object, an insulator for a terminal-connecting portion of the present invention comprises an elastic insulator body in an L-shaped hollow form. The insulator body includes: a first inlet formed in a first end of said insulator body for receiving a first terminal with a generally rectangular shape; a second inlet formed in a second end of said insulator body for receiving a second terminal; a curved portion having an exterior wall constituted by an outer corner wall part, an inner corner wall part, and opposite side wall parts; and a draining hole formed in one of said opposite side wall parts of said exterior wall. The first terminal is held in said insulator body with two out of four corners of said first terminal at its leading end being closely and elastically contacted with the interior at said second end and with one of the other two corners being closely and elastically contacted with the interior at said outer corner part of said exterior wall. The second terminal inserted through said second inlet into said insulator body is connected to said first terminal inserted through said first inlet into said insulator body.

In order to achieve the second object, in the insulator for a terminal connecting portion of the present invention, a peripheral edge around said draining hole in said insulator body extends outwardly to form a cylindrical interference-proofing portion.

In order to further achieve the second object, in an insulator for a terminal-connecting portion of the present invention, the draining hole extends from said outer corner wall part to one of said opposite side wall parts eccentrically with the center line on a wall face area of said one side wall part so that said wall face area remains on said outer corner wall part of said exterior wall of said curved portion, and the peripheral edge around the draining hole in said insulator body extends outwardly on a plane containing axes of said first and second ends of said insulator body to form a cylindrical interference-proofing portion.

According to the insulator for a terminal-connecting portion of the present invention, since the insulator body is provided with the draining hole on the side wall out of the exterior wall forming the curved portion, the outer corner wall part of the curved portion is left and the inner peripheral face of the outer corner wall part is closely and elastically mounted on the corner of the first terminal. Since the inner peripheral face of the second end of the insulator body is closely and elastically mounted on two corners out of three remained corners, the first terminal is supported on three points, so that a sufficient force of holding the terminal can be obtained. Further, it is possible to efficiently drain water such as rain or the like, while enters into the insulator body, from the draining hole, since the hole can be formed to have a large diameter.

According to the insulator for a terminal connecting portion, since a peripheral edge around said draining hole in said insulator body extends outwardly to form a cylindrical interference-proofing portion, any part disposed around the insulator contacts with the cylindrical interference-proofing portion, so that the part cannot contact with the first terminal through the draining hole, thereby preventing a short circuit in a terminal section.

According to the insulator for a terminal-connecting portion, since the draining hole extends from said outer corner wall part to one of said opposite side wall parts eccentrically with the center line on a wall face area of said one side wall part so that said wall face area remains on said outer corner wall part of said exterior wall of said curved portion, and the peripheral edge around the draining hole in said insulator body extends outwardly on a plane containing axes of said first and second ends of said insulator body to form a cylindrical interference-proofing portion, the inner peripheral face of the outer corner wall is closely and elastically mounted on the corner of the first terminal. Since the inner peripheral face of the second end of the insulator body is closely and elastically mounted on two corners out of three remaining corners, the first terminal is supported on three points, so that a sufficient force of holding a terminal can be obtained. Further, it is possible to efficiently drain water such as rain or the like, which enters into the insulator body, from the draining hole, since the hole can be formed to have a large diameter. Since a peripheral edge around said draining hole in said insulator body extends outwardly to form a cylindrical interference-proofing portion, any part disposed around the insulator contacts with the cylindrical interference-proofing portion, so that the part can not contact with the first terminal through the draining hole, thereby preventing a short circuit in a terminal section.

DETAILED DESCRIPTION OF THE PREFERRED EMBODIMENTS

Referring now to FIGS. 1 through 23, embodiments of an insulator for a terminal-connecting portion in accordance with the present invention will be described below.

<A first embodiment>

Figure 1:
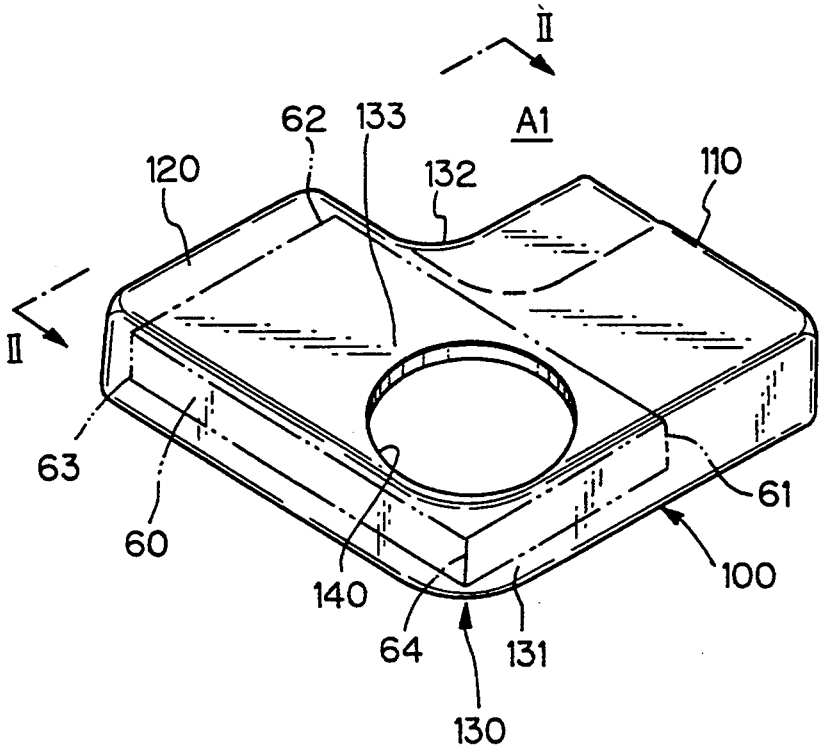
FIG. 1 is a perspective view of a first embodiment of an insulator of the present invention.
Figure 2:
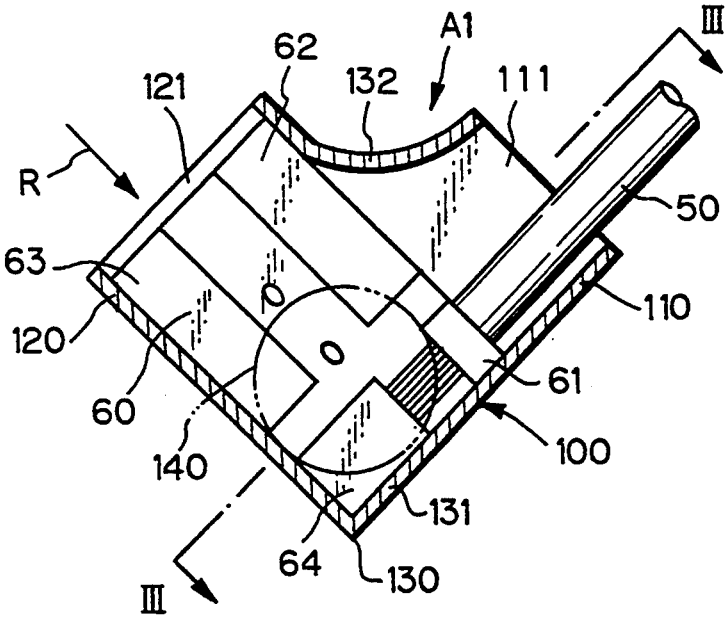
FIG. 2 is a cross sectional view taken along lines II—II in FIG. 1.
Figure 3:
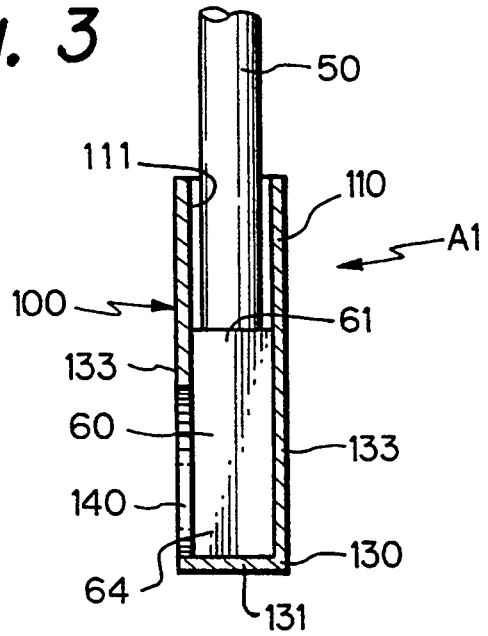
FIG. 3 is a cross sectional view taken along lines III—III in FIG. 2.

FIG. 1 shows a perspective view of a first embodiment of an insulator A1 for a terminal-connecting portion in accordance with the present invention and FIGS. 2 and 3 are cross sectional views illustrating the insulator A1.

As shown in the drawings, the insulator A1 comprises an L-shaped cylindrical hollow insulator body 100 made of an elastic material such as a soft PVC (polyvinyl chloride) or the like. The insulator body 100 is provided with a female terminal inlet 111 in a first end 110 thereof and a male terminal inlet 121 in a second end 120 thereof. Further, an exterior wall of a curved portion 130 of the insulator body 100 is constituted by an outer corner wall part 131, an inner corner wall part 132, opposite side wall parts 133. One of the opposite side wall parts 133 is provided with a draining hole 140 having a large diameter of about 4 mm or so.

Figure 4:
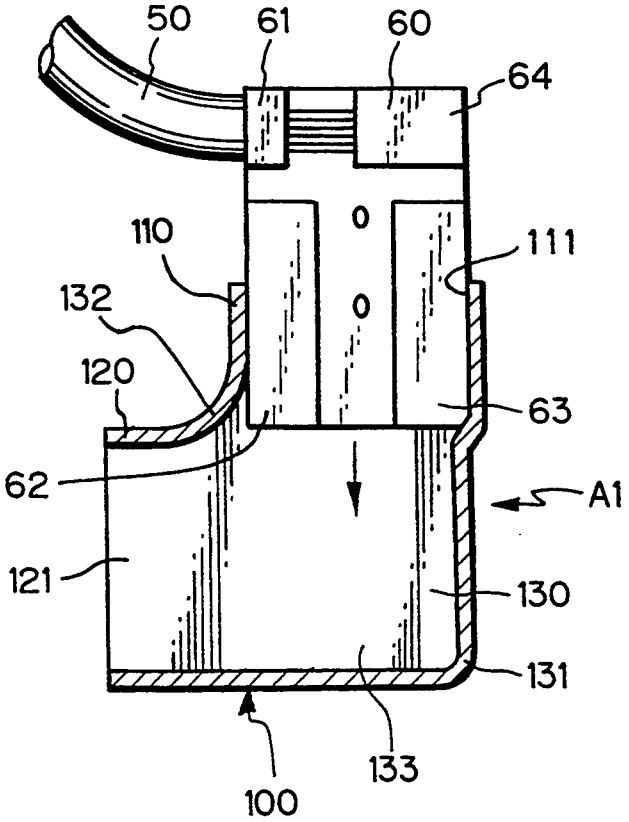
FIG. 4 is a cross sectional view taken along lines II—II in FIG. 1 and illustrates a state in which a female terminal is inserted into the insulator.
Figure 5:
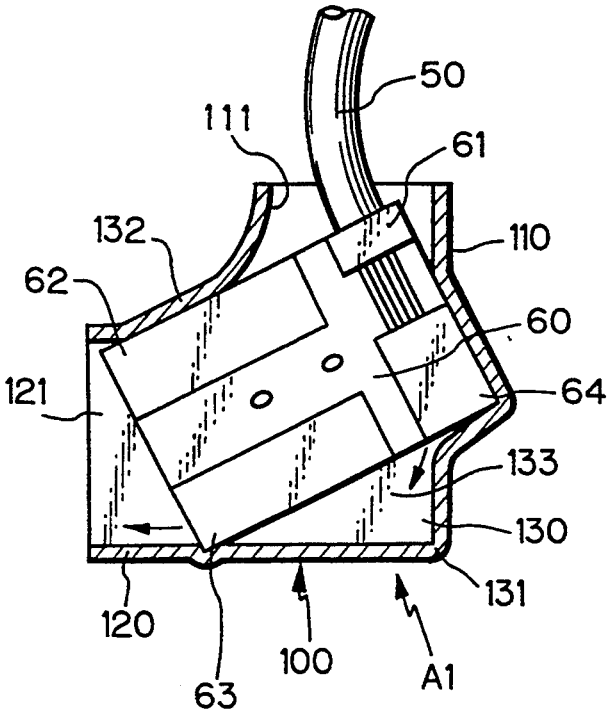
FIG. 5 is a cross sectional view taken along lines II—II in FIG. 1 and illustrates another in which the female terminal is inserted into the insulator.

As shown in FIGS. 4 and 5, a female terminal 60 having a generally rectangular shape and connected to a main electrical cable 50 is inserted through the inlet 111 into the insulator body 100 of the insulator A1 while the terminal 60 widens the inlet 111 against an elastic force thereof. Then, the female terminal 60 is closely and elastically contacted with the inner peripheral face of the insulator body 100 by its elastic recovery force at three parts 62 to 64 of the terminal 60 exclusive of a corner 61 connected to the main electrical cable 50. As shown by an arrow R in FIG. 2, a male terminal (not shown) connected to a joint electrical cable (not shown) is inserted through the male terminal inlet 121 into the insulator body 100 so that the male terminal is coupled to the female terminal in the body.

According to the insulator A1, the outer corner wall part 131 of the curved portion 130 remains on the insulator body 100 in spite of forming the draining hole 140 into a large diameter since the draining hole 140 is provided in the side wall part 133 of the curved portion 130. Since the outer corner wall part 131 contacts closely with a corner 64 of the female terminal 60 at the inner peripheral face and the second end 120 contacts closely with two corners 62 and 63 out of the remaining three corners 61 to 63 at the inner peripheral face, the female terminal 60 is supported on three points and a substantial force of holding the terminal can be obtained. In addition, since it is possible to enlarge the draining hole 140 by utilizing the side wall part 133, it is possible to efficiently drain water such as rain or the like, which enters into the insulator A1, from the draining hole 140 to the outside.

Figure 6:
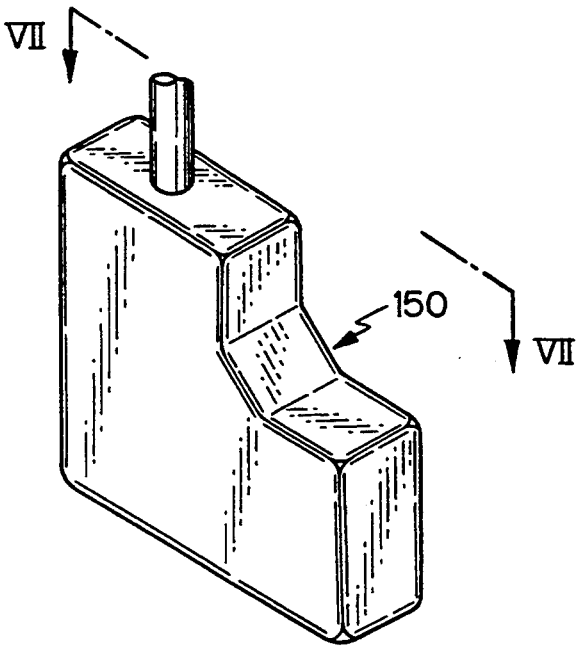
FIG. 6 is a perspective view of a core to be used upon producing the first embodiment of the insulator.
Figure 7:
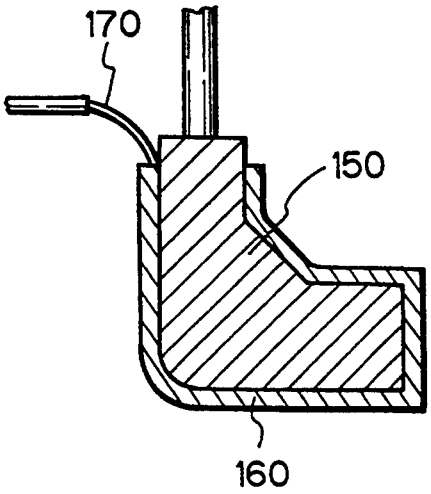
FIG. 7 is a cross sectional view taken along lines VII—VII in FIG. 6 and illustrates a method of producing the first embodiment of the insulator.

The insulator A1 is produced by a dip-forming process. That is, as shown in FIG. 6, a core 150 is prepared which is formed in accordance with the interior contour of the insulator A1. The core 150 is dipped into a liquid of a soft PVC material so that a PVC material 160 attaches to the exterior of the core 150 as shown in FIG. 7.

Figure 8:
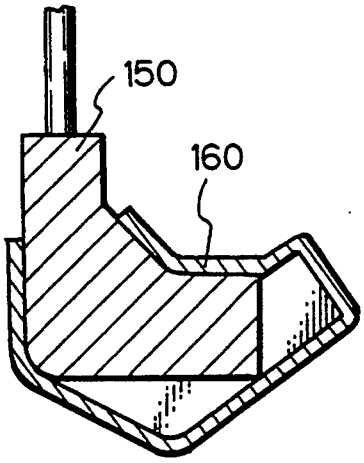
FIG. 8 is another cross sectional view taken along lines VII—VII in FIG. 6 and illustrates a method of producing the first embodiment of the insulator.
Figure 9:
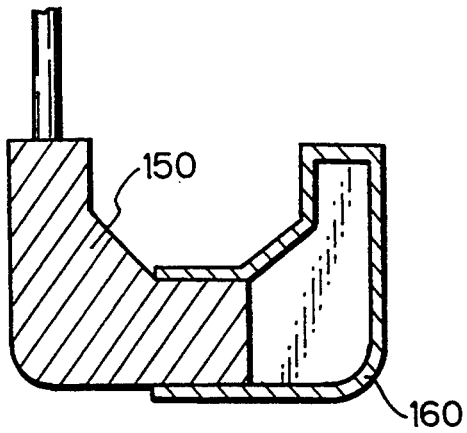
FIG. 9 is still another cross sectional view taken along lines VII—VII in FIG. 6 and illustrates a method of producing the first embodiment of the insulator.

After the PVC material 160 hardness in a little, an air nozzle 170 is inserted between the core 150 and the PVC material 160. Then, the PVC material 160 is removed from the core 150 as shown in FIGS. 8 and 9, while blowing air from the nozzle into the interior of the PVC material 160.

Figure 10:
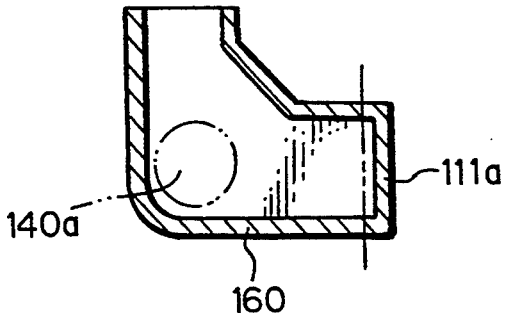
FIG. 10 is an explanatory view of a method of producing the first embodiment of the insulator.

After removing the PVC material 160 from the core 150, an end section 111*a* (a section corresponding to a first end 110 shown in FIG. 1) is cut off as shown by a two dot chain line in FIG. 10 so as to form the female terminal inlet 111 and a side wall section 140*a* is drilled out so as to form the draining hole 140. Thus, the insulator A1 shown in FIG. 1 is made.

<A second embodiment>

Figure 11:
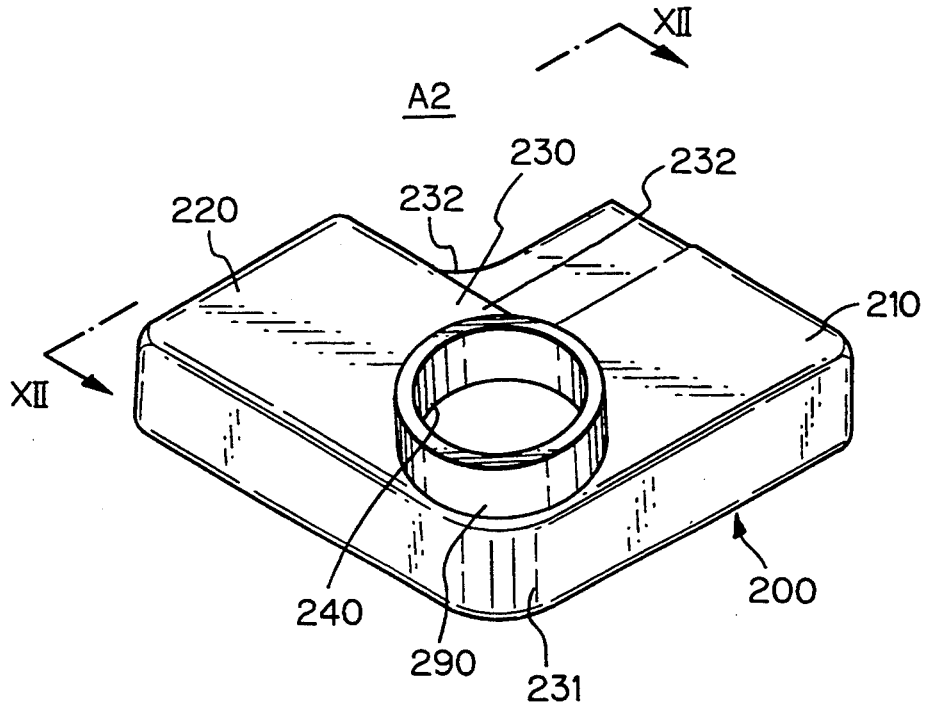
FIG. 11 is a perspective view of a second embodiment of the insulator of the present invention.
Figure 12:
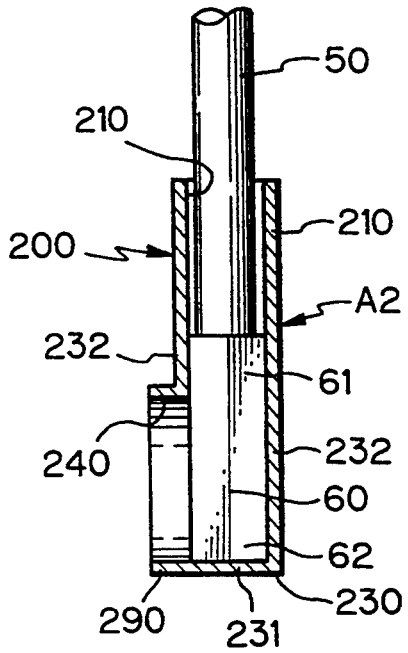
FIG. 12 is a cross sectional view taken along lines XII—XII in FIG. 11.

FIG. 11 is a perspective view of a second embodiment of an insulator A2 for a terminal connecting portion of the present invention and FIG. 12 is a cross sectional view of the insulator A2. As shown in the drawings, the insulator A2 is provided around a draining hole 240 in an insulator body 200 with a cylindrical interference-profiling portion 290 which is integrally formed on and is projected outwardly from a peripheral edge of the hole 240.

Since the remaining construction of the insulator A2 is the same as that of the first insulator A1, it is not explained here and the same parts are illustrated by the same or similar signs.

This insulator A2 can obtain an additional effect as well as the effect obtained by the insulator A1 since the cylindrical interference-proofing portion 290 is formed around the draining hole 240. That is, none of the parts arranged around the insulator A2 comes into contact with the female terminal 60 in the insulator A2 through the draining hole 240 on account of interference of the portion 290.

Figure 13:
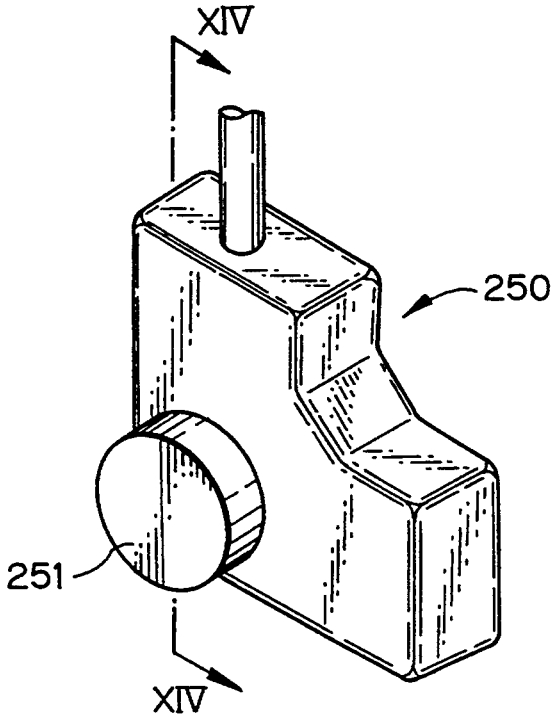
FIG. 13 is a perspective view of a core to be used upon producing the second embodiment of the insulator.
Figure 14:
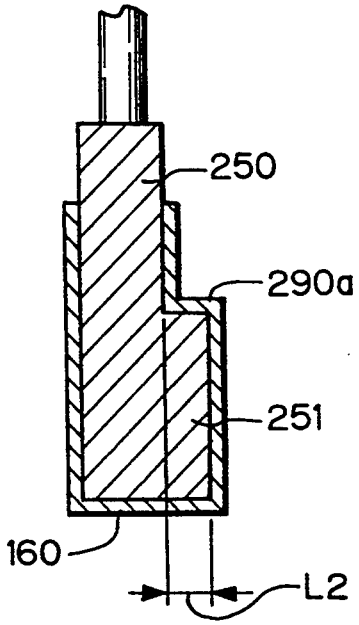
FIG. 14 is a cross sectional view taken along liens XIV—XIV in FIG. 13 and illustrates a method of producing the second embodiment of the insulator.

In the case of producing the insulator A2, as shown in FIG. 13, a core 250 is prepared which has a cylindrical protrusion 251 on an area associated with the cylindrical interference-proofing portion 290. The core 250 is dipped into a molten PVC material so that a PVC material 160 attaches to the exterior of the core 250 as shown in FIG. 14.

After the core 250 is removed from the PVC material 160 in the same manner as the first embodiment a top end of a section 290*a* for the cylindrical interference-proofing portion 290 is cut off and a section for the female terminal inlet 211 is cut off. Then, the insulator A2 shown in FIG. 11 is made.

<A third embodiment>

FIG. 15 to 21 illustrate a third embodiment of an insulator A3 for a terminal-connecting portion of the present invention. As shown in tile drawings, the insulator A3 comprises an L-shaped cylindrical hollow insulator body 300 made of an elastic material such as a soft PVC (polyvinyl chloride) or the like. The insulator body 300 is provided with a female terminal inlet 311 at a first end 310 thereof and with a made terminal inlet 321 at a second end 320 thereof. Further, the draining hole 340 extends from an outer corner wall part 331 to a side wall part 333 eccentrically with the center line on a wall face area 331*a* on the side wall part 333 so that the wall face area 331*a* remains on the outer corner wall part 331 of a curved portion 330. A peripheral edge around the draining hole 340 in the insulator body 300 extends outwardly on a plane containing axes of the first and second ends 310 and 320 of the insulator body 300 to form a cylindrical interference-proofing portion 390 united to the insulator body 300 and having an inner diameter of 4 mm.

Since the remaining construction of the third insulator A3 is the same as that of the first and second insulators A1 and A2, it is not explained here and the same parts are illustrated by the same or similar signs.

The generally rectangular female terminal 60 connected to the main electrical cable 50 is inserted into the insulator body 300 of the insulator A3 through the inlet 311, while the terminal 60 widens the inlet 311 against its elastic force. Then, the insulator body 300 contacts closely with the corners 62 and 63 of the female terminal 60 by its elastic recovery force on the inner peripheral face at the second end 320 thereof and contacts closely with the corner 64 of the female terminal 60 on the wall face area 331*a* of the outer corner wall part 331 of the curved portion 330. Consequently, the female terminal is held in the insulator A3.

Figure 20:
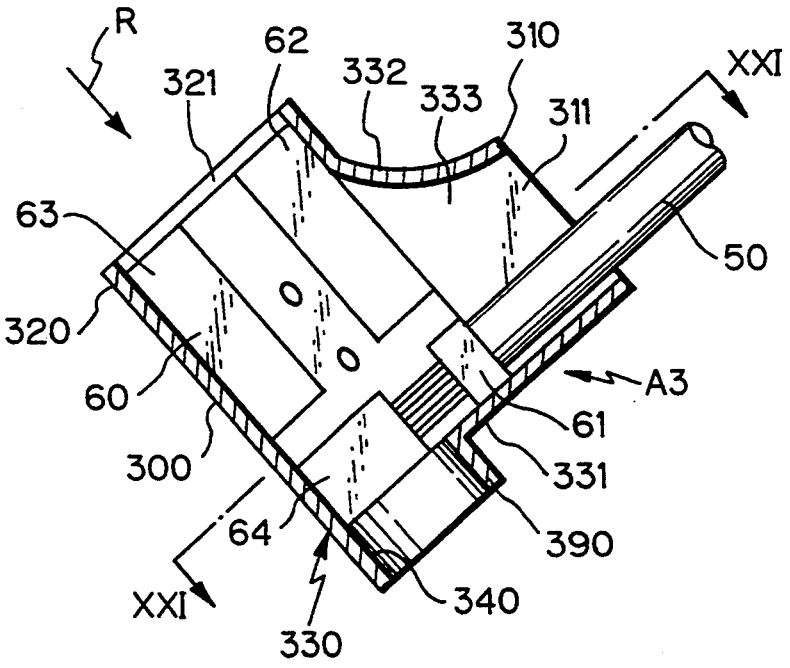
FIG. 20 is a cross sectional view taken along lines XX—XX in FIG. 15.
Figure 21:
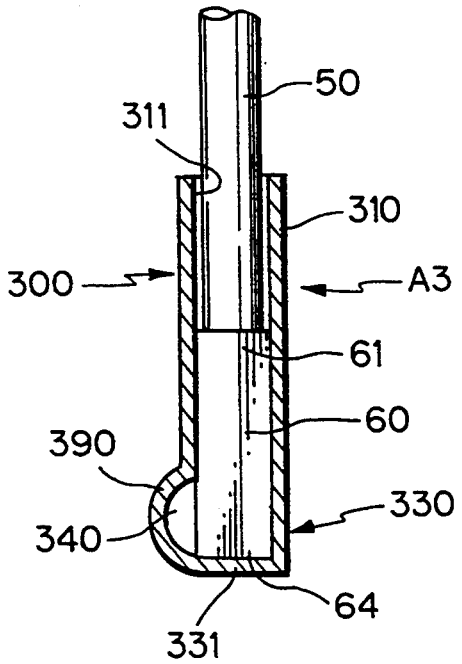
FIG. 21 is a cross sectional view taken along lines XXI—XXI in FIG. 20.

A male terminal (not shown) connected to a joint electrical cable (not shown) is inserted through the male terminal inlet 321 into the insulator body 300 as shown by an arrow R in FIG. 20 and the male terminal is coupled to the female terminal 60.

According to the third insulator A3, since the draining hole 340 extends from the outer corner wall part 331 to the side wall part 333 eccentrically with the center line on the wall face area 331*a* on the side wall part 333 so that the wall face area 331*a* remains on the outer corner wall part 331 of the curved portion 330, the inner peripheral face on the wall face area 331*a* of the outer corner part 331 at the first end 310 contacts closely and elastically with the corner 64 of the female terminal 60 and the inner peripheral face at the second end 320 contacts closely and elastically with the two corners 62 and 63 at the leading end out of the remaining three corners 61 to 63. Accordingly, the female terminal 60 is supported on three points in the insulator A3 and a great force for holding the terminal can be obtained. Further, since the large draining hole 340 is formed from the outer corner wall part 331 to the side wall part 333 on the curved portion 330, moisture entrapped in the insulator A3 can be efficiently drained from tile hole 340.

Also, since tile insulator body 300 is provided with the cylindrical interference-proofing portion 390 around the draining hole 340, any parts arranged around the insulator A3 contacts with not the female terminal 60 but the portion 390, thereby preventing a short circuit.

The insulator A3 of the third embodiment can be produced more easily than the insulator A2 of the second embodiments.

Figure 15:
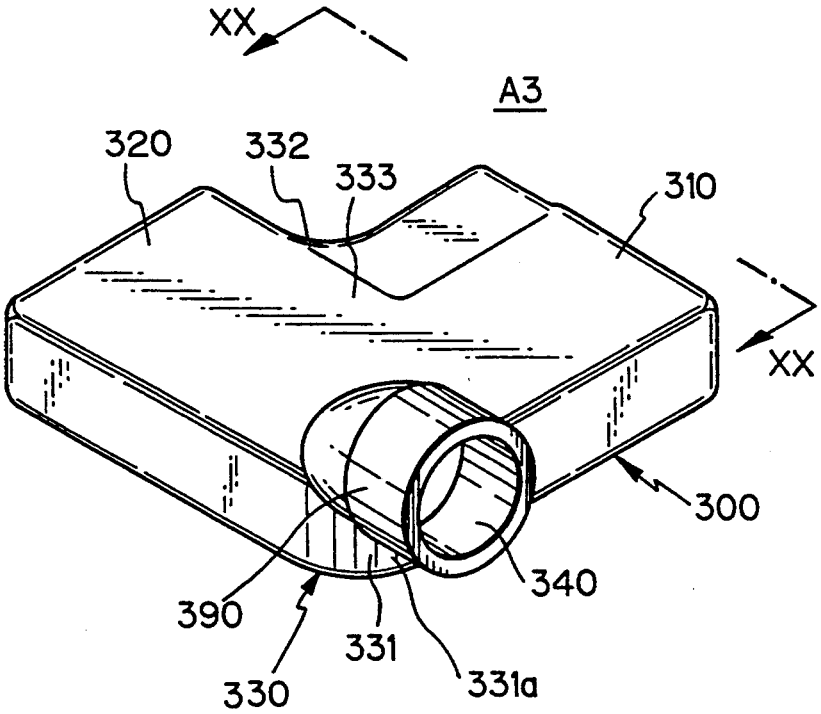
FIG. 15 is a perspective view of a third embodiment of the insulator of the present invention.
Figure 16:
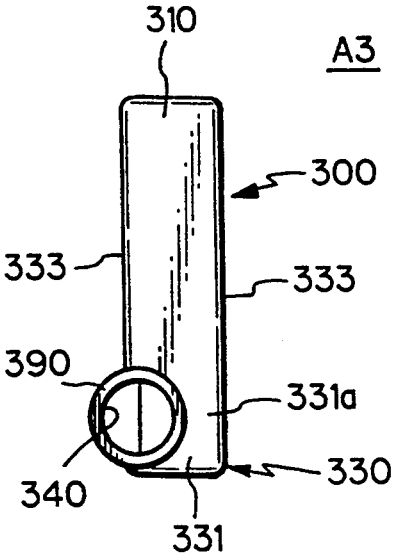
FIG. 16 is a front side view of the third embodiment of the insulator.
Figure 17:
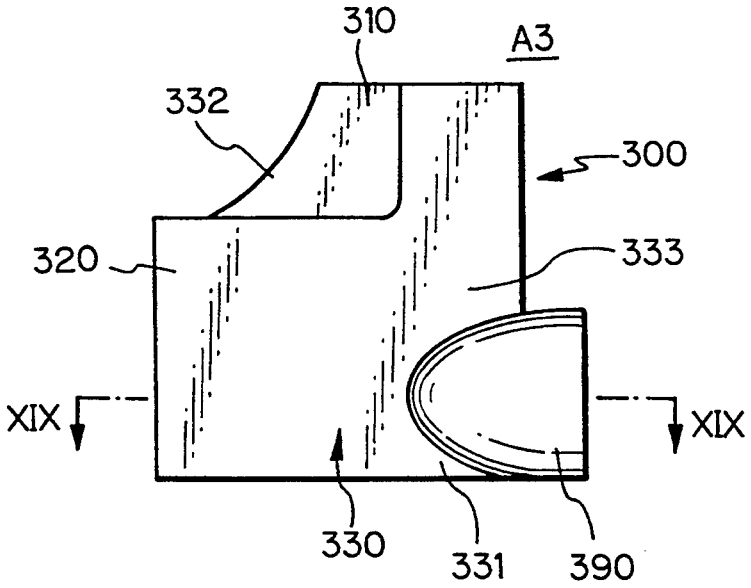
FIG. 17 is a side view of the third embodiment of the insulator.
Figure 18:
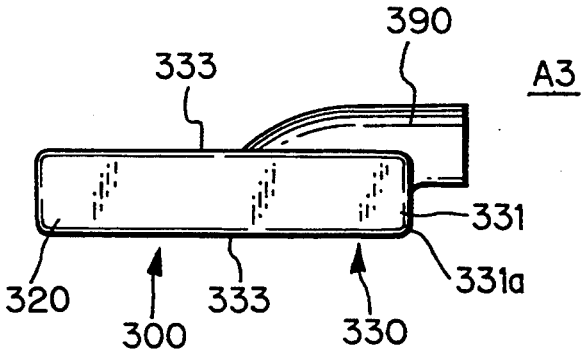
FIG. 18 is a bottom side view of the third embodiment of the insulator.
Figure 19:
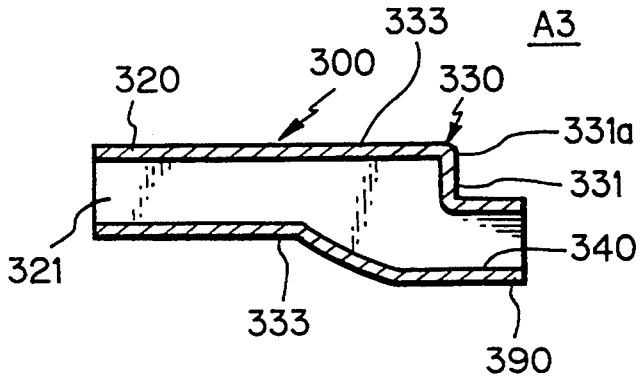
FIG. 19 is a cross sectional view taken along liens XIX—XIX in FIG. 17.
Figure 22:
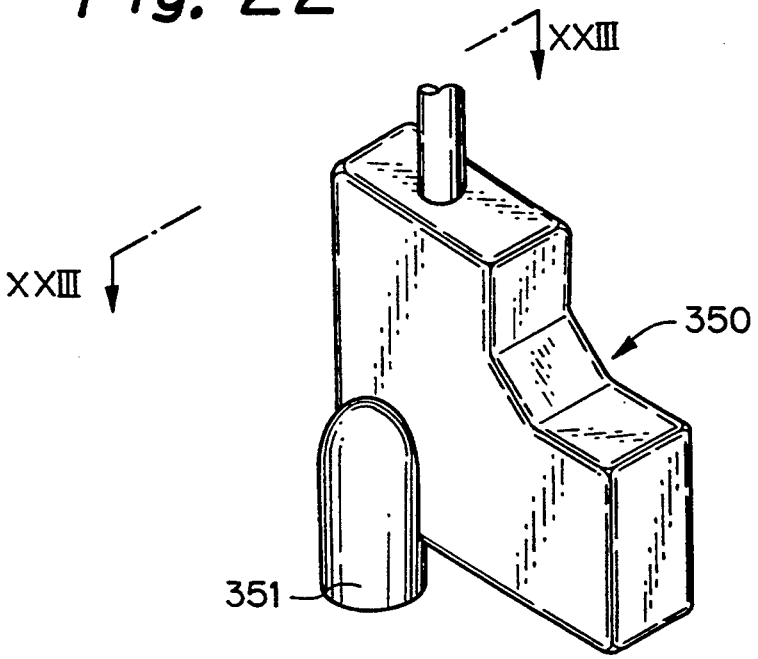
FIG. 22 is a perspective view of a core to be used upon producing the third embodiment of the insulator.
Figure 23:
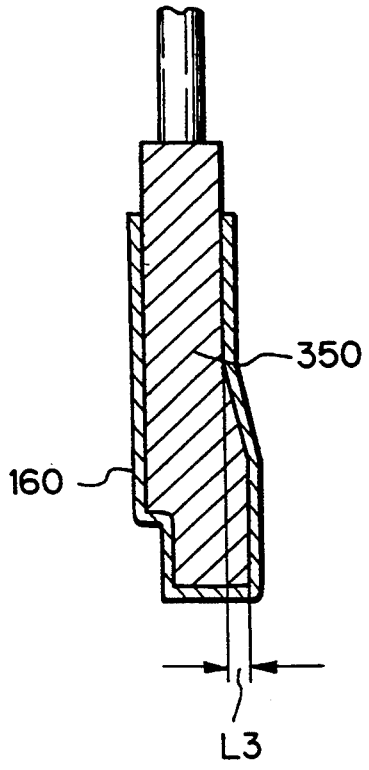
FIG. 23 is a cross sectional view taken along lines XXIII—XXIII in FIG. 22 and illustrates a method of producing the third embodiment of tile illustrator.
Figure 24:
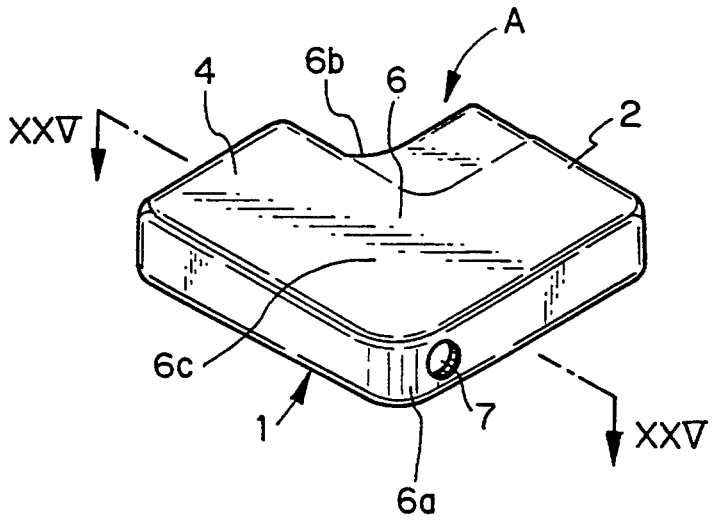
Fig. 24 PRIOR ART
FIG. 24 is a perspective view of a prior insulator.
Figure 25:
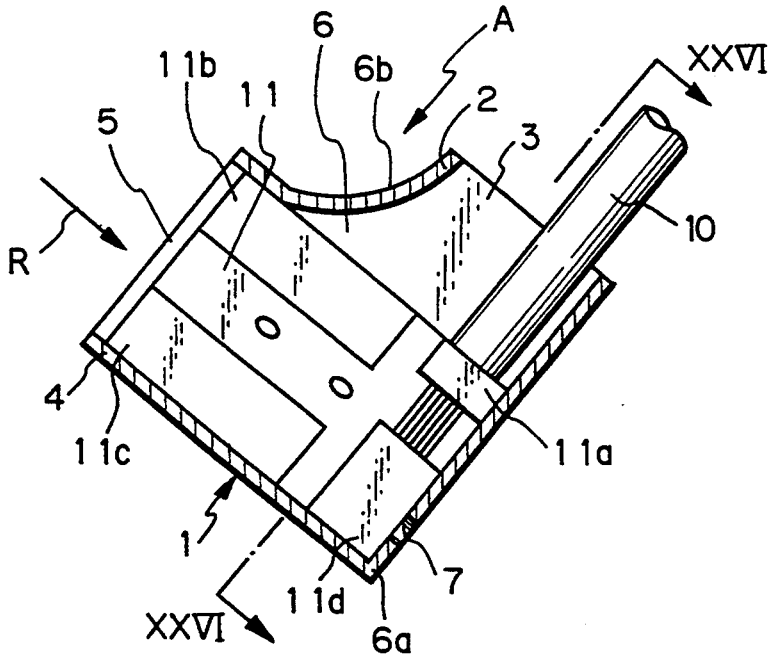
Fig. 25 PRIOR ART
FIG. 25 is a cross sectional view taken along lines XXV—XXV in FIG. 24 and illustrates a state in which a female terminal is inserted into an insulator.
Figure 26:
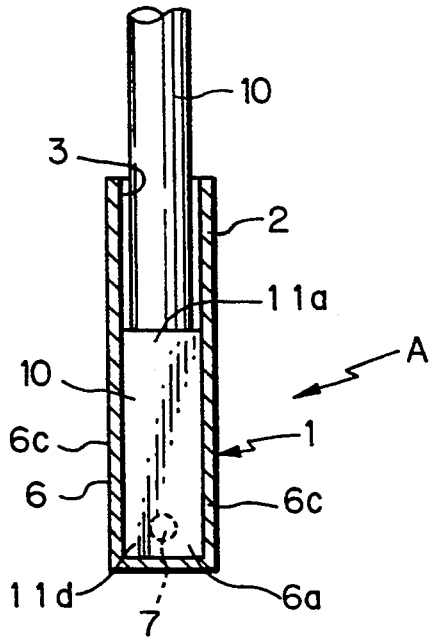
Fig. 26 PRIOR ART
FIG. 26 Is a cross sectional view taken along lines XXVI—XXVI in FIG. 25.
Figure 27:
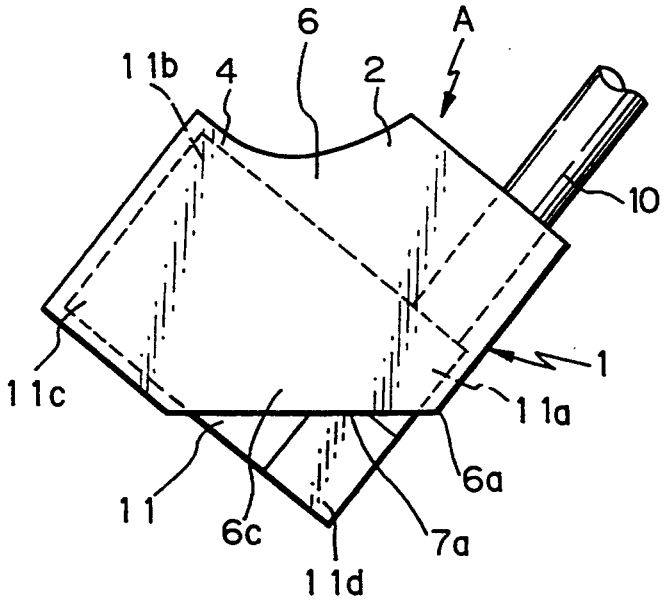
Fig. 27 PRIOR ART
FIG. 27 is a front side view of the prior insulator, illustrating a problem of the prior insulator.

In the case of producing the insulator A3, as shown in FIG. 22, a core 350 is prepared which has a cylindrical projection 351 on an area for the cylindrical interference-proofing portion 390. The core 350 is dipped into a molten PVC material in the same manner as the first and second embodiments so that the PVC material 160 is attached to the exterior of the core 350 as shown in FIG. 23. After the core 350 is drawn from the PVC material 160, given parts are cut out and the insulator A3 shown in FIG. 15 is made.

Since the cylindrical interference-proofing portion 390 is formed along a drawing direction of the core 350 (axis direction of the second end 320), it is possible to set a height L3 (FIG. 23) of the projection 351 of the core 350 to be smaller than a height L2 (FIG. 14) of the projection 251 of the core 250 in the second embodiment shown in FIGS. 13 and 14. Accordingly, in comparison with the core 250 of the second embodiment, since a contacting area between the projection 351 and the PVC material 160 becomes smaller, the core 350 can be readily drawn from the PVC material 160. Consequently, the insulator A3 of the third embodiment can be easily made.

The extending direction of the cylindrical interference-proofing portion 390 in the third embodiment is not limited to the direction described above. If the portion 390 is extended outwardly on a plane containing the axes of the first and second ends 310 and 320, the core 350 can be easily drawn from the PVC material 160.

According to the insulator for a terminal-connecting portion of the present invention, since the insulator body is provided with the draining hole on the side wall part out of the exterior walls forming tile curved portion, the outer corner wall part of the curved portion is left and the inner peripheral face of the outer corner wall part is closely and elastically mounted on the corner portion of the first terminal. Since the inner peripheral face of the second end of the insulator body is closely and elastically mounted on two corners out of three remaining corners, the first terminal is supported on three points, so that a sufficient force of holding a terminal can be obtained. Further, it is possible to efficiently drain water such as rain or the like, which enters into tile insulator body, from the draining hole, since the hole can be formed into a large diameter.

According to the insulator for a terminal-connecting portion, since a peripheral edge around said draining hole in said insulator body extends outwardly to form a cylindrical interference-proofing portion, any part disposed around the insulator contacts with the cylindrical interference-proofing portion, so that such a part does not come into contact with the first terminal through the draining hole, thereby preventing a short circuit in a terminal section.

According to the insulator for a terminal connecting portion, since the draining hole extends from said outer corner wall part to one of said opposite side wall parts eccentrically with tile center line on a wall face area of said one side wall part so that said wall face area remains on said outer corner wall part of said exterior wall of said curved portion, and the peripheral edge around the draining hole in said insulator body extends outwardly on a plane containing axes of said first and second ends of said insulator body to form a cylindrical Interference-proofing portion, the inner peripheral face of the outer corner wall part is closely and elastically mounted on the corner of the first terminal. Since the inner peripheral face of the second end of the insulator body is closely and elastically mounted on two corners out of three remaining corners, the first terminal is supported on three points, so that a sufficient force of holding a terminal can be obtained. Further, it is possible to efficiently drain water such as rain or the like, which enters into the insulator body, from the draining hole, since the hole can be formed into a large diameter. Since a peripheral edge around said draining hole in said insulator body extends outwardly to form a cylindrical interference-proofing portion, any part disposed around the insulator contacts with the cylindrical interference-proofing portion, so that the part cannot come into contact with the first terminal through the draining hole, thereby preventing a short circuit in a terminal section.

What is claimed is:

1. An insulator, for a terminal connecting portion which includes a first terminal having a generally rectangular shape and a second terminal, comprising an elastic insulator body in an L-shaped hollow form, said insulator body including:

a first inlet formed in a first end of said insulator body for receiving the first terminal having the generally rectangular shape;

a second inlet formed in a second end of said insulator body for receiving the second terminal;

a curved portion having an exterior wall constituted of an outer corner wall part, an inner corner wall part, and opposite side wall parts; and a draining hole formed in one of said opposite side wall parts of said exterior wall said draining hole being large in size relative to said one of said opposite side wall parts, so that said draining hole extends over a substantial portion of said one of said opposite side wall parts;

whereby the first terminal is held in said insulator body with two out of four corners of the first terminal at its leading end being closely and elastically contacted with the interior at said second end and with one of the other two corners being closely and elastically contacted with the interior at said outer corner part of said exterior wall; and whereby the second terminal inserted through said second inlet into said insulator body is connected to the first terminal inserted through said first inlet into said insulator body.

2. An insulator for a terminal-connecting portion according to claim 1, wherein a peripheral edge around said draining hole in said insulator body extends outwardly to form a cylindrical interference-proofing portion.

3. An insulator for a terminal-connecting portion according to claim 1, wherein said draining hole extends from said outer corner wall part to one of said opposite side wall parts eccentrically with tile center line on a wall face area of said one side wall part so that said wall face area remains on said outer corner wall part of said exterior wall of said curved portion, and wherein a peripheral edge around said draining hole in said insulator body extends outwardly on a plane containing axes of said first and second ends of said insulator body to form a cylindrical interference-proofing portion.

4. An insulator, for a terminal connecting portion which includes a first terminal having a generally rectangular shape and a second terminal, comprising an elastic insulator body in an L-shaped hollow form, said insulator body including:

a first inlet formed in a first end of said insulator body for receiving the first terminal having the generally rectangular shape;

a second inlet formed in a second end of said insulator body for receiving the second terminal;

a curved portion having an exterior wall constituted of an outer corner wall part, an inner corner wall part, and opposite side wall parts; and a moisture draining hole formed in one of said opposite side wall parts of said exterior wall;

whereby the first terminal is held in said insulator body with two out of four corners of the first terminal at its leading end being closely and elastically contacted with the interior at said second end and with one of the other two corners being closely and elastically contacted with the interior at said outer corner part of said exterior wall; and whereby the second terminal inserted through said second inlet into said insulator body is connected to the first terminal inserted through said first inlet into said insulator body;

wherein a peripheral edge around said moisture draining hole in said insulator body extends outwardly to form a cylindrical interference-proofing portion.

5. An insulator, for a terminal connecting portion which includes a first terminal having a generally rectangular shape and a second terminal, comprising an elastic insulator body in an L-shaped hollow form, said insulator body including:

a first inlet formed in a first end of said insulator body for receiving the first terminal having the generally rectangular shape;

a second inlet formed in a second end of said insulator body for receiving the second terminal;

a curved portion having an exterior wall constituted of an outer corner wall part, an inner corner wall part, and opposite side wall parts; and a draining hole formed in one of said opposite side wall parts of said exterior wall;

whereby the first terminal is held in said insulator body with two out of four corners of the first terminal at its leading end being closely and elastically contacted with the interior at said second end and with one of the other two corners being closely and elastically contacted with the interior at said outer corner part of said exterior wall; and whereby the second terminal inserted through said second inlet into said insulator body is connected to the first terminal inserted through said first inlet into said insulator body;

wherein said draining hole extends from said outer corner wall part to one of said opposite side wall parts eccentrically with the center line on a wall face area of said one side wall part so that said wall face area remains on said outer corner wall part of said exterior wall of said curved portion, and wherein a peripheral edge around said draining hole in said insulator body extends outwardly on a plane containing axes of said first and second ends of said insulator body to form a cylindrical interference-proofing portion.

* * * * *